US006736738B1

(12) United States Patent
Taa

(10) Patent No.: US 6,736,738 B1
(45) Date of Patent: May 18, 2004

(54) FOOTBALL TARGET PRACTICE APPARATUS

(76) Inventor: Bermie A. Taa, 1104 Sunrise Way, Milpitas, CA (US) 95035

( * ) Notice: Subject to any disclaimer, the term of this patent is extended or adjusted under 35 U.S.C. 154(b) by 6 days.

(21) Appl. No.: 10/132,955

(22) Filed: Apr. 26, 2002

(51) Int. Cl.[7] ..... A63B 69/00; A63B 63/00

(52) U.S. Cl. ..... 473/439; 273/402

(58) Field of Search ..... 473/441–448, 473/422, 439, 433, 462, 470, 471, 478, 173, 154, 163, 476, 481, 435, 454, 104, 125–127; 273/348, 410, 398–408, 412, 349, 350, 351, 359, 354, 355, 369, 371, 127 B; 446/396, 220, 221, 223, 226, 124, 71, 76, 325; 482/83–86, 87, 90, 35, 36; 434/251; D21/698–700, 656

(56) References Cited

U.S. PATENT DOCUMENTS

| | | | | | |
|---|---|---|---|---|---|
| 2,237,599 | A | * | 4/1941 | Gilman | 482/85 |
| 2,937,872 | A | | 5/1960 | Gilman | |
| 2,939,707 | A | * | 6/1960 | Lemelson | 273/402 |
| 3,048,395 | A | * | 8/1962 | Hobbs | 472/128 |
| 3,163,419 | A | * | 12/1964 | Lemelson | 273/401 |
| 3,180,639 | A | * | 4/1965 | Cotler et al. | 472/129 |
| 3,350,097 | A | * | 10/1967 | Chevrette et al. | 273/350 |
| 3,391,936 | A | * | 7/1968 | Grimes | 473/439 |
| 3,416,795 | A | * | 12/1968 | Lewis et al. | 473/444 |
| 3,558,135 | A | * | 1/1971 | Rees et al. | 473/444 |
| 3,573,867 | A | | 4/1971 | Mehrens | |
| 3,580,578 | A | * | 5/1971 | McCarthy | 473/471 |
| 3,680,862 | A | | 8/1972 | Russell et al. | |
| 3,810,618 | A | * | 5/1974 | Nedwick | 473/439 |
| 3,913,916 | A | * | 10/1975 | Martin, Jr. | 473/479 |
| 4,092,023 | A | | 5/1978 | Hazen | |
| 4,529,390 | A | * | 7/1985 | Levy et al. | 446/220 |
| 4,824,414 | A | * | 4/1989 | Goldblatt | 446/226 |
| 4,936,578 | A | * | 6/1990 | Hudson, Sr. | 473/439 |
| 5,037,095 | A | * | 8/1991 | Nedwick | 473/439 |
| 5,335,906 | A | | 8/1994 | Delker | |
| D354,922 | S | | 1/1995 | Gartner | |
| 5,573,252 | A | * | 11/1996 | Simmons | 273/454 |
| 5,632,490 | A | * | 5/1997 | Brown | 273/350 |

* cited by examiner

*Primary Examiner*—Gregory Vidovich
*Assistant Examiner*—Mitra Aryanpour

(57) ABSTRACT

A football target practice apparatus for allowing a user to practice one's football throwing skills. The football target practice apparatus includes a base member being adapted to rest upon a ground; and also includes a football catching assembly including an elongate upright tubular member being mounted upon the base member and having a side wall, a cavity disposed inside thereof, and holes being disposed through the side wall and being adapted to allow a football to pass therethrough.

10 Claims, 3 Drawing Sheets

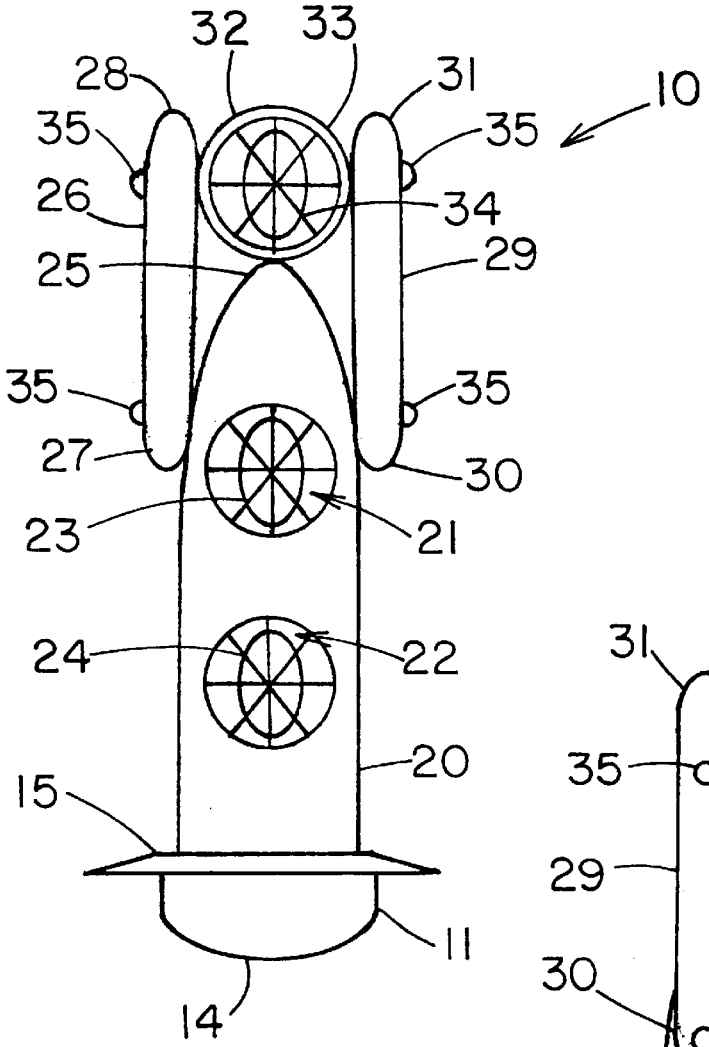
FIG. 3
FIG. 4
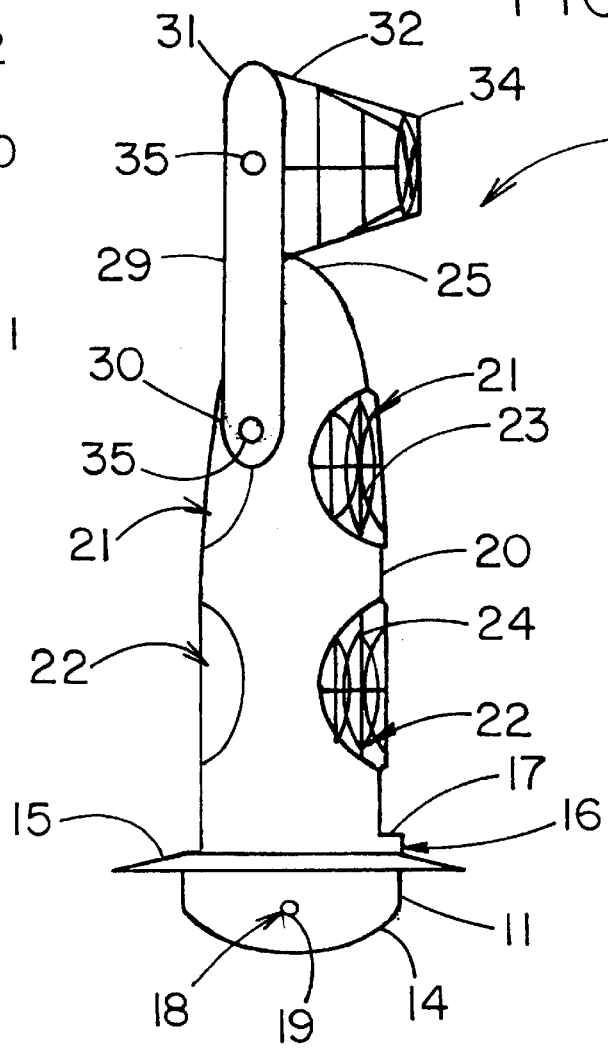

FOOTBALL TARGET PRACTICE APPARATUS

BACKGROUND OF THE INVENTION

1. Field of the Invention

The present invention relates to a football catcher and more particularly pertains to a new football target practice apparatus for allowing a user to practice one's football throwing skills.

2. Description of the Prior Art

The use of a football catcher is known in the prior art. More specifically, a football catcher heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,335,906; U.S. Pat. No. 3,573,867; U.S. Pat. No. 3,680,862; U.S. Pat. No. 2,937,872; U.S. Pat. No. 4,092,023; and U.S. Pat. No. Des. 354,922.

While these devices fulfill their respective, particular objectives and requirements, the aforementioned patents do not disclose a new football target practice apparatus. The inventive device includes a base member being adapted to rest upon a ground; and also includes a football catching assembly including an elongate upright tubular member being mounted upon the base member and having a side wall, a cavity disposed inside thereof, and holes being disposed through the side wall and being adapted to allow a football to pass therethrough.

In these respects, the football target practice apparatus according to the present invention substantially departs from the conventional concepts and designs of the prior art, and in so doing provides an apparatus primarily developed for the purpose of allowing a user to practice one's football throwing skills.

SUMMARY OF THE INVENTION

In view of the foregoing disadvantages inherent in the known types of football catcher now present in the prior art, the present invention provides a new football target practice apparatus construction wherein the same can be utilized for allowing a user to practice one's football throwing skills.

The general purpose of the present invention, which will be described subsequently in greater detail, is to provide a new football target practice apparatus which has many of the advantages of the football catcher mentioned heretofore and many novel features that result in a new football target practice apparatus which is not anticipated, rendered obvious, suggested, or even implied by any of the prior art football catcher, either alone or in any combination thereof.

To attain this, the present invention generally comprises a base member being adapted to rest upon a ground; and also includes a football catching assembly including an elongate upright tubular member being mounted upon the base member and having a side wall, a cavity disposed inside thereof, and holes being disposed through the side wall and being adapted to allow a football to pass therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new football target practice apparatus which has many of the advantages of the football catcher mentioned heretofore and many novel features that result in a new football target practice apparatus which is not anticipated, rendered obvious, suggested, or even implied by any of the prior art football catcher, either alone or in any combination thereof.

It is another object of the present invention to provide a new football target practice apparatus which may be easily and efficiently manufactured and marketed.

It is a further object of the present invention to provide a new football target practice apparatus which is of a durable and reliable construction.

An even further object of the present invention is to provide a new football target practice apparatus which is susceptible of a low cost of manufacture with regard to both materials and labor, and which accordingly is then susceptible of low prices of sale to the consuming public, thereby making such football target practice apparatus economically available to the buying public.

Still yet another object of the present invention is to provide a new football target practice apparatus which provides in the apparatuses and methods of the prior art some of the advantages thereof, while simultaneously overcoming some of the disadvantages normally associated therewith.

Still another object of the present invention is to provide a new football target practice apparatus for allowing a user to practice one's football throwing skills.

Yet another object of the present invention is to provide a new football target practice apparatus which includes a base member being adapted to rest upon a ground; and also includes a football catching assembly including an elongate upright tubular member being mounted upon the base member and having a side wall, a cavity disposed inside thereof, and holes being disposed through the side wall and being adapted to allow a football to pass therethrough.

Still yet another object of the present invention is to provide a new football target practice apparatus that can be easily and quickly set up upon a ground.

Even still another object of the present invention is to provide a new football target practice apparatus that allows the user practice one's throwing accuracy at high and low targets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of a second embodiment of the present invention.

FIG. 4 is a side elevational view of the second embodiment of the present invention.

DESCRIPTION OF THE PREFERRED EMBODIMENT

Figure 1:
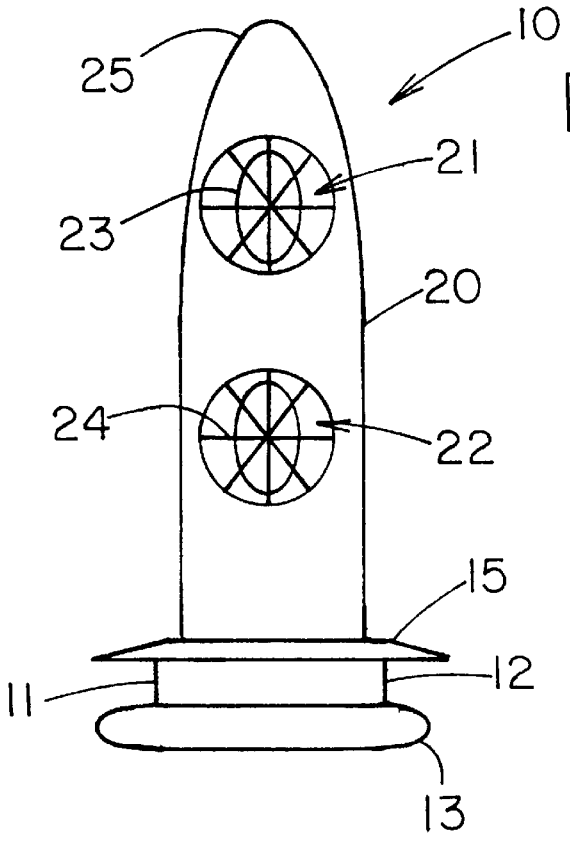
FIG. 1 is a front elevational view of a new football target practice apparatus according to the present invention.
Figure 2:
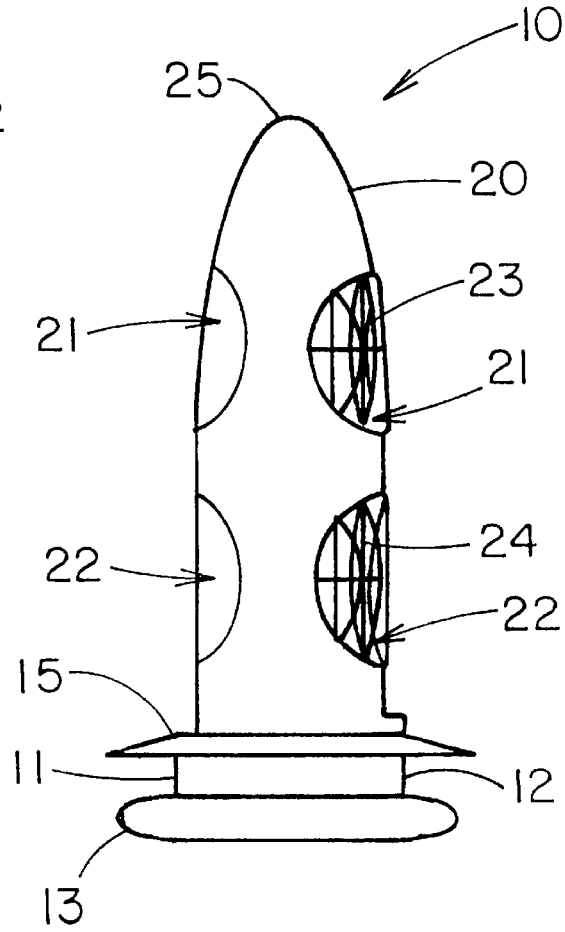
FIG. 2 is a side elevational view of the present invention.
Figure 5:
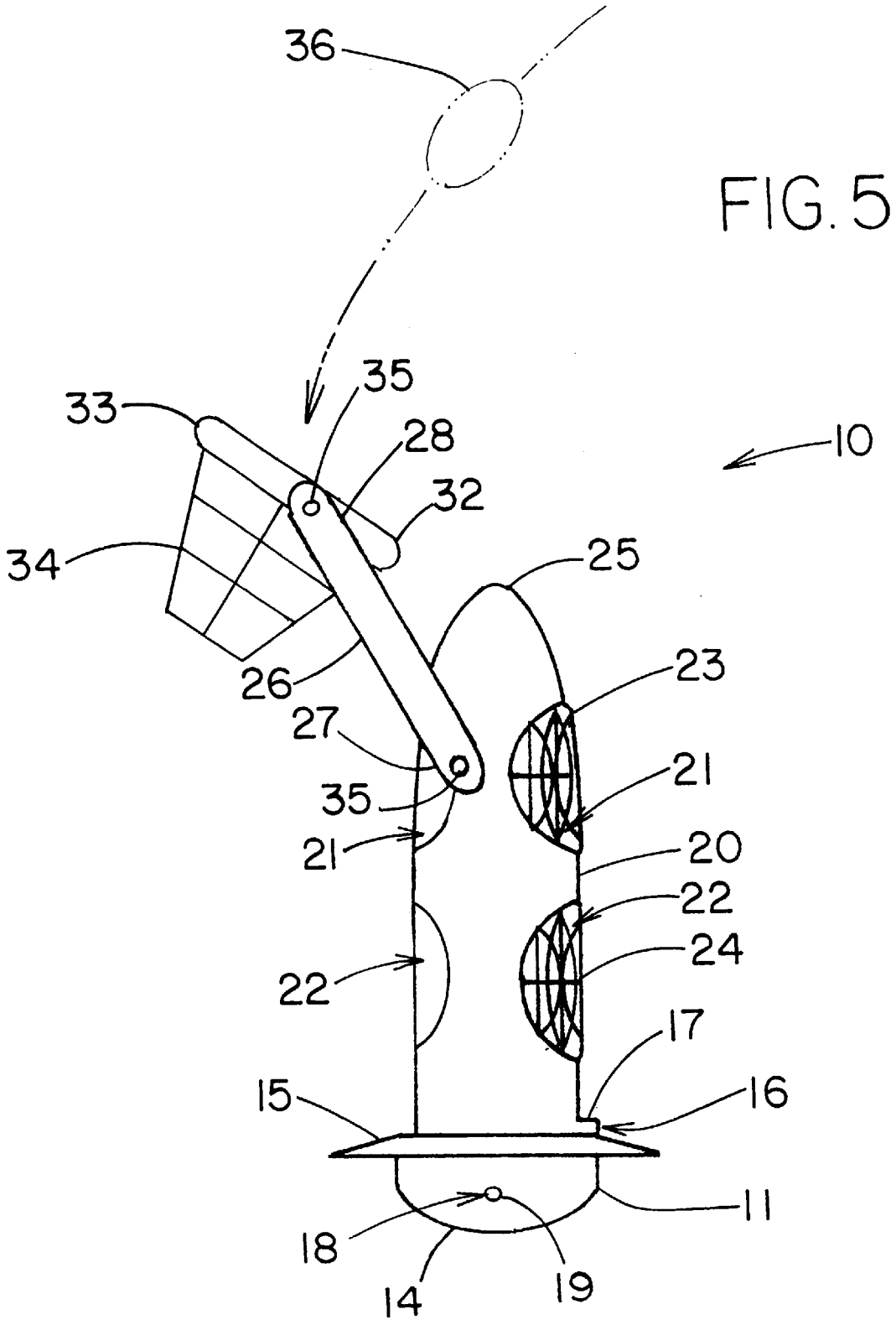
FIG. 5 is a side elevational view of the second embodiment of the present invention shown in use.

With reference now to the drawings, and in particular to FIGS. 1 through 5 thereof, a new football target practice apparatus embodying the principles and concepts of the present invention and generally designated by the reference numeral 10 will be described.

As best illustrated in FIGS. 1 through 5, the football target practice apparatus 10 generally comprises a base member 11 being adapted to rest upon a ground. The base member 11 is weighted and includes an annular flange member 15 being conventionally attached about an exterior of a side wall of the base member 11 with the base member 11 having a height of approximately 2½ feet.

A football catching assembly includes an elongate upright tubular member 20 being conventionally mounted upon the base member 11 and having a side wall, a cavity disposed inside thereof, and holes 21,22 being disposed through the side wall and being adapted to allow a football 36 to pass therethrough. The holes 21,22 include upper holes 21 which are diametrically-opposed to one another, and also include lower holes 22 which are diametrically-opposed to one another. The football catching assembly further includes nets 24, 23 being conventionally disposed in one of the upper holes 21 and in one of the lower holes 22 to effectively catch a football 36 being received through the other upper and lower holes 21,22. The elongate upright tubular member 20 has a parabolic shaped top portion 25. The elongate upright tubular member 20 has a height of approximately 4 to 5 feet and having a diameter of approximately 3 feet.

As a first embodiment, the base member 11 includes an upper portion 12 and an enlarged lower portion 13 for stabilizing the elongate upright tubular member 20 with the annular flange member 15 being securely and conventionally attached about an exterior of the upper portion 12 of the base member 11.

As a second embodiment, the football catching assembly also includes a pair of arms 26,29 having first ends 27,30 which are pivotally and adjustably attached with fasteners 35 to the elongate upright tubular member 20, and further includes a basket member 32 being pivotally and adjustably attached with fasteners 35 to second ends 28,31 of the arms 26,29. The arms 26,29 are pivotally and adjustably attached to diametrically-opposed sides of the elongate upright tubular member 20 and are attached to the top portion 25 of the elongate upright tubular member 20. The basket member 32 includes a rim 33 and a netting member 34 being conventionally attached to the rim 33. The base member 11 has a rounded bottom side 14 to allow the elongate upright tubular member 20 to bob, and further has a fill opening 16 being disposed in a top of the base member 11 and being closeable with a first closure member 17, and also has a drain opening 18 being disposed in the base member 11 near a bottom thereof and being closeable with a second closure 19 with the base member 11 being adapted to hold filler material therein.

In use, the user sets up the football target practice apparatus 10 upon a ground and stands away from the football target practice apparatus 10 and throws the football 36 at the upper and lower holes 21,22 of the elongate upright tubular member 20 with the object of throwing the football 36 through the holes 21,22. The nets 23,24 retrieve the football 36 for the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A football target practice apparatus comprising:

a base member being adapted to rest upon a ground; and a football catching assembly including an elongate upright tubular member being mounted upon said base member, said upright tubular member having a side wall, a cavity disposed inside thereof, and holes being disposed through said side wall and being adapted to allow a football to pass therethrough;

said holes includes upper holes which are diametrically-opposed to one another, and also includes lower holes which are diametrically-opposed to one another;

said football catching assembly further includes nets being disposed in one of said upper holes and in one of said lower holes to effectively catch a football being received through said other upper and lower holes;

said elongate upright tubular member has a parabolic shaped top portion; and said base member includes an upper portion and an enlarged lower portion for stabilizing said elongate upright tubular member, said annular flange member being securely attached about an exterior of said upper portion of said base member.

2. A football target practice apparatus as described in claim 1, wherein said base member is weighted and includes said annular flange member being attached about an exterior of said side wall of said base member.

3. A football target practice apparatus comprising:

a base member being adapted to rest upon a ground;

a football catching assembly including an elongate upright tubular member being mounted upon said base member, said upright tubular member having a side wall, a cavity disposed inside thereof, and holes being disposed through said side wall and being adapted to allow a football to pass therethrough;

said holes includes upper holes which are diametrically-opposed to one another, and also includes lower holes which are diametrically-opposed to one another;

said football catching assembly further includes nets being disposed in one of said upper holes and in one of said lower holes to effectively catch a football being received through said other upper and lower holes;

said elongate upright tubular member has a parabolic shaped top portion; and said football catching assembly also includes a pair of arms having first ends which are pivotally and adjustably attached with fasteners to said elongate upright tubular member, and further includes a basket member being pivotally and adjustably attached with fasteners to second ends of said arms.

4. A football target practice apparatus as described in claim 3, wherein said arms are pivotally attached to diametrically-opposed sides of said elongate upright tubular member and are attached to said top portion of said elongate upright tubular member.

5. A football target practice apparatus as described in claim 4, wherein said basket member includes a rim and a netting member being attached to said rim.

6. A football target practice apparatus as described in claim 5, wherein said base member has a rounded bottom side to allow said elongate upright tubular member to bob, and further has a fill opening being disposed in a top of said base member and being closeable with a first closure member, and also has a drain opening being disposed in said base member near a bottom thereof and being closeable with a second closure, said base member being adapted to hold filler material therein.

7. A football target practice apparatus as described in claim 3, wherein said base member is weighted and includes said annular flange member being attached about an exterior of said side wall of said base member.

8. A football target practice apparatus comprising:

a base member being adapted to rest upon a ground, said base member being weighted and includes an annular flange member being attached about an exterior of a side wall of said base member, said base member having a height of approximately 2½ feet; and a football catching assembly including an elongate upright tubular member being mounted upon said base member, said upright tubular member having a side wall, a cavity disposed inside thereof, and holes being disposed through said side wall and being adapted to allow a football to pass therethrough, said holes including upper holes which are diametrically-opposed to one another, and also including lower holes which are diametrically-opposed to one another, said football catching assembly further including nets being disposed in one of said upper holes and in one of said lower holes to effectively catch a football being received through said other upper and lower holes, said elongate upright tubular member having a parabolic shaped top portion, said elongate upright tubular member having a height of approximately 4 to 5 feet and having a diameter of approximately 3 feet.

9. A football target practice apparatus as described in claim 8, wherein said base member includes an upper portion and an enlarged lower portion for stabilizing said elongate upright tubular member, said annular flange member being securely attached about an exterior of said upper portion of said base member.

10. A football target practice apparatus as described in claim 8, wherein said football catching assembly also includes a pair of arms having first ends which are pivotally and adjustably attached with fasteners to said elongate upright tubular member, and further includes a basket member being pivotally and adjustably attached with fasteners to second ends of said arms, said arms being pivotally attached to diametrically-opposed sides of said elongate upright tubular member and being attached to said top portion of said elongate upright tubular member, said basket member including a rim and a netting member being attached to the rim, said base member having a rounded bottom side to allow said elongate upright tubular member to bob, and further having a fill opening being disposed in a top of said base member and being closeable with a first closure member, and also having a drain opening being disposed in said base member near a bottom thereof and being closeable with a second closure, said base member being adapted to hold filler material therein.

* * * * *